US010039397B2

(12) United States Patent
Wang

(10) Patent No.: US 10,039,397 B2
(45) Date of Patent: Aug. 7, 2018

(54) SEASONING JAR

(71) Applicant: YUAN MIN ALUMINUM CO., LTD., Tainan (TW)

(72) Inventor: Kuan-Hsiang Wang, Tainan (TW)

(73) Assignee: Yuan Min Aluminum Co., Ltd., Tainan (TW)

( * ) Notice: Subject to any disclaimer, the term of this patent is extended or adjusted under 35 U.S.C. 154(b) by 499 days.

(21) Appl. No.: 14/737,665

(22) Filed: Jun. 12, 2015

(65) Prior Publication Data

US 2015/0366385 A1 Dec. 24, 2015

(30) Foreign Application Priority Data

Jun. 19, 2014 (TW) ..... 103210820 U

(51) Int. Cl.

| | |
|---|---|
| ***B65D 8/02*** | (2006.01) |
| ***B65D 25/38*** | (2006.01) |
| ***A47G 19/24*** | (2006.01) |
| *B65D 8/06* | (2006.01) |

(52) U.S. Cl.

CPC ..... *A47G 19/24* (2013.01)

(58) Field of Classification Search

CPC ..... A47G 19/24

USPC .... 215/364; 220/8, 23.87, 23.89, 625, 345.4

See application file for complete search history.

(56) References Cited

U.S. PATENT DOCUMENTS 3,173,589 A * 3/1965 Dike ..... A47G 19/24 222/479
3,338,458 A * 8/1967 Hultgren ..... A45D 40/06 206/457
3,819,081 A * 6/1974 Runte ..... B01L 9/06 206/446
4,530,470 A * 7/1985 Beilstein ..... A47G 19/24 222/142.7
5,605,242 A * 2/1997 Hwang ..... B65D 21/086 220/4.03
5,651,506 A * 7/1997 Hockey ..... A47G 19/24 222/142.1

(Continued)

FOREIGN PATENT DOCUMENTS

TW 355998 4/1999
TW M401380 U1 4/2011

*Primary Examiner* — J. Gregory Pickett
*Assistant Examiner* — Niki M Eloshway
(74) *Attorney, Agent, or Firm* — Rosenberg, Klein & Lee

(57) ABSTRACT

A seasoning jar includes a position restriction groove concavely disposed at the bottom of a jar body, a through hole disposed along the central axis of the jar body to accommodate an accommodating tube. Multiple openings are formed through an upper wall of the accommodating tube to communicate with the inner space of the accommodating tube. A stopper is connected to the bottom of the accommodating tube to abut against the position restriction groove. A sealing cover covers the top end of the accommodating tube, and a bottom cover is disposed on the bottom end of the jar body. When used, the seasoning jar is tilted to allow the accommodating tube to slide in the through hole to pour out the seasoning inside the accommodating tube through the multiple openings. When unused, the accommodating tube can be automatically accommodated in the jar body by gravity after being placed upright.

7 Claims, 5 Drawing Sheets

(56) References Cited

U.S. PATENT DOCUMENTS

| | | | | |
|---|---|---|---|---|
| 5,823,379 | A * | 10/1998 | Friedlander | B65D 11/16 215/297 |
| 6,290,059 | B1 * | 9/2001 | Chuan | A24F 15/20 206/238 |
| 6,536,441 | B2 * | 3/2003 | Chuan | A24F 15/18 131/187 |
| 7,194,951 | B1 * | 3/2007 | Porter | A47J 31/005 100/116 |
| 2014/0061234 | A1 * | 3/2014 | Eldreth | B05B 11/0045 222/105 |
| 2015/0344180 | A1 * | 12/2015 | Shakoori Divani | B65D 21/086 206/459.1 |

* cited by examiner

SEASONING JAR

BACKGROUND

Field of Invention

The disclosure relates to a seasoning jar. More particularly, the disclosure relates to a seasoning jar that can easily access seasonings, and the plural openings of the seasoning jar can be automatically closed after pouring the seasoning.

Description of Related Art

The seasoning jars disclosed by TW Pat. No. 355998, "improvement of seasoning jar," and TW Pat. No. M401380, "structure of seasoning jar," are commonly seen in the market. When these seasoning jars are used, the rotating covers have to be rotated to align the openings of the rotating covers and the openings of the top covers, so that the seasonings can be poured out. Therefore, it is inconvenient for people with poor eyesight. Another disadvantage is that people often forget to rotate the rotating covers to misalign the openings of the rotating covers and the top covers. Consequently, the outside air can enter the seasoning jar to contact the seasoning for a long time to make the seasoning damp, agglomeration, and thus deterioration. In another condition, insets, such as ants, can enter the seasoning jar.

SUMMARY OF THE INVENTION

This invention is related to a structure of seasoning jar. The seasoning jar is only needed to be tilted to an angle when used, and the seasoning inside the accommodating tube can be poured out through the vias of the accommodating tube. When the seasoning jar is not used, the accommodating tube can be automatically accommodated in a jar body after the jar is placed uprightly. Therefore, this design can prevent a user from forgetting close the vias to make the seasoning inside become damped, agglomerated and deteriorated, or being entered by insects and ants.

BRIEF DESCRIPTION OF THE DRAWINGS

The invention can be more fully understood by reading the following detailed description of the embodiment, with reference made to the accompanying drawings as follows.

DETAILED DESCRIPTION OF THE PREFERRED EMBODIMENT

Figure 1:
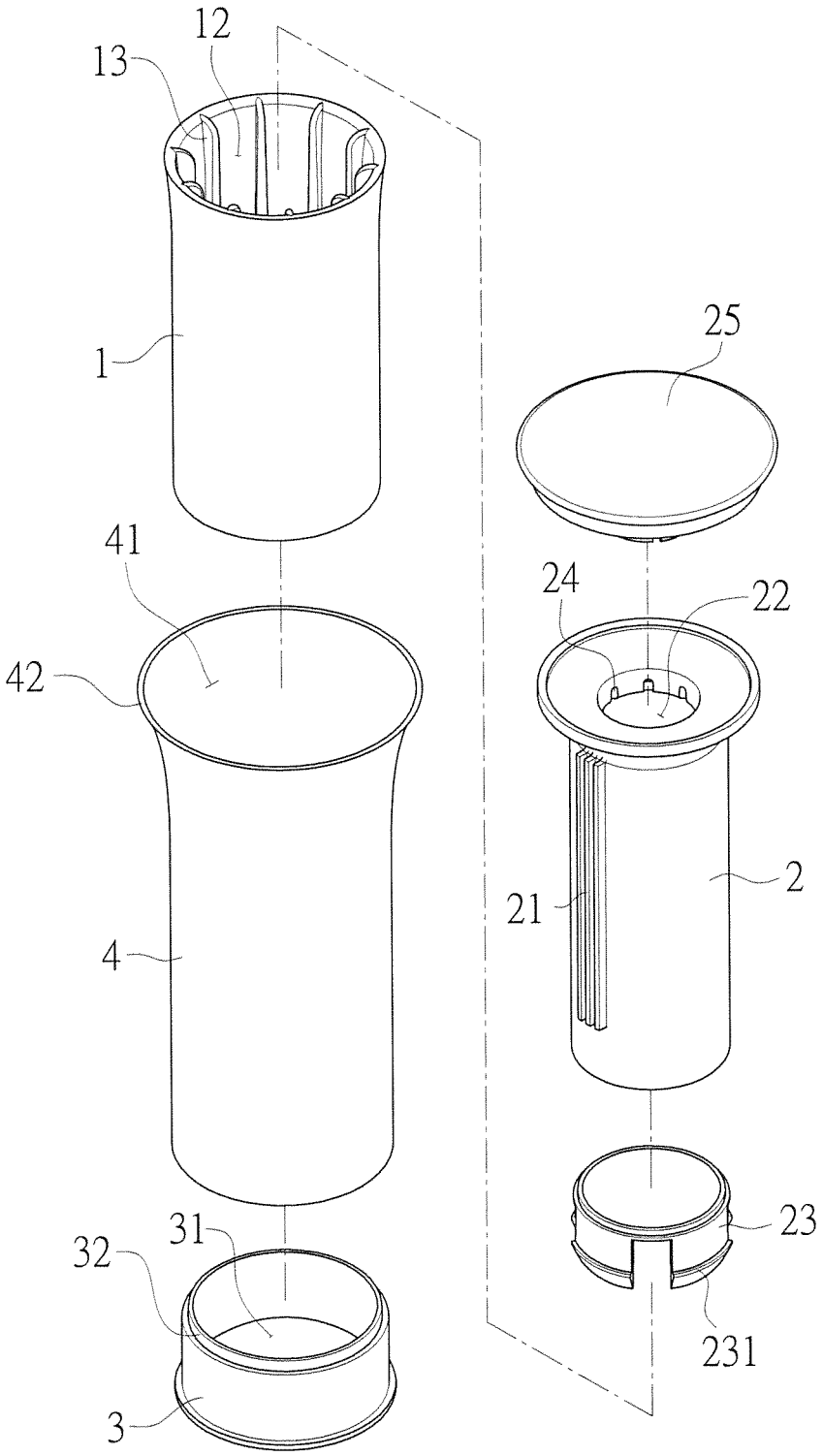
FIG. 1 is an exploded perspective view of a seasoning jar according an embodiment of this disclosure.
Figure 2:
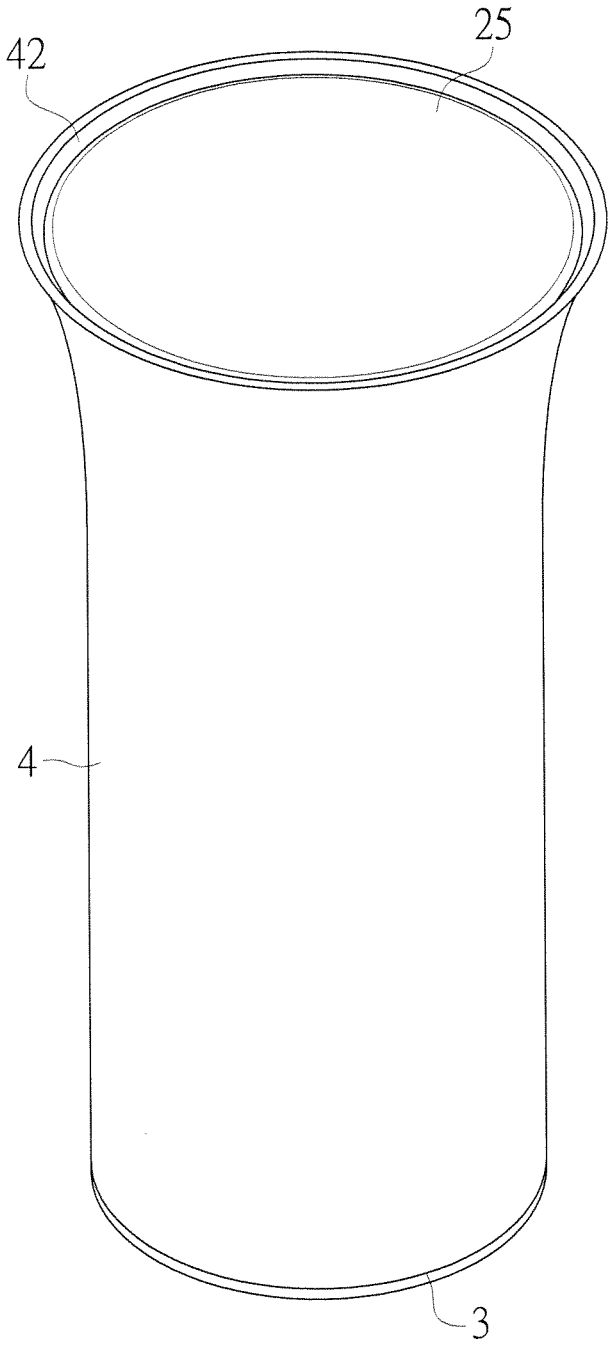
FIG. 2 is a perspective vies of a seasoning jar according an embodiment of this disclosure.
Figure 3:
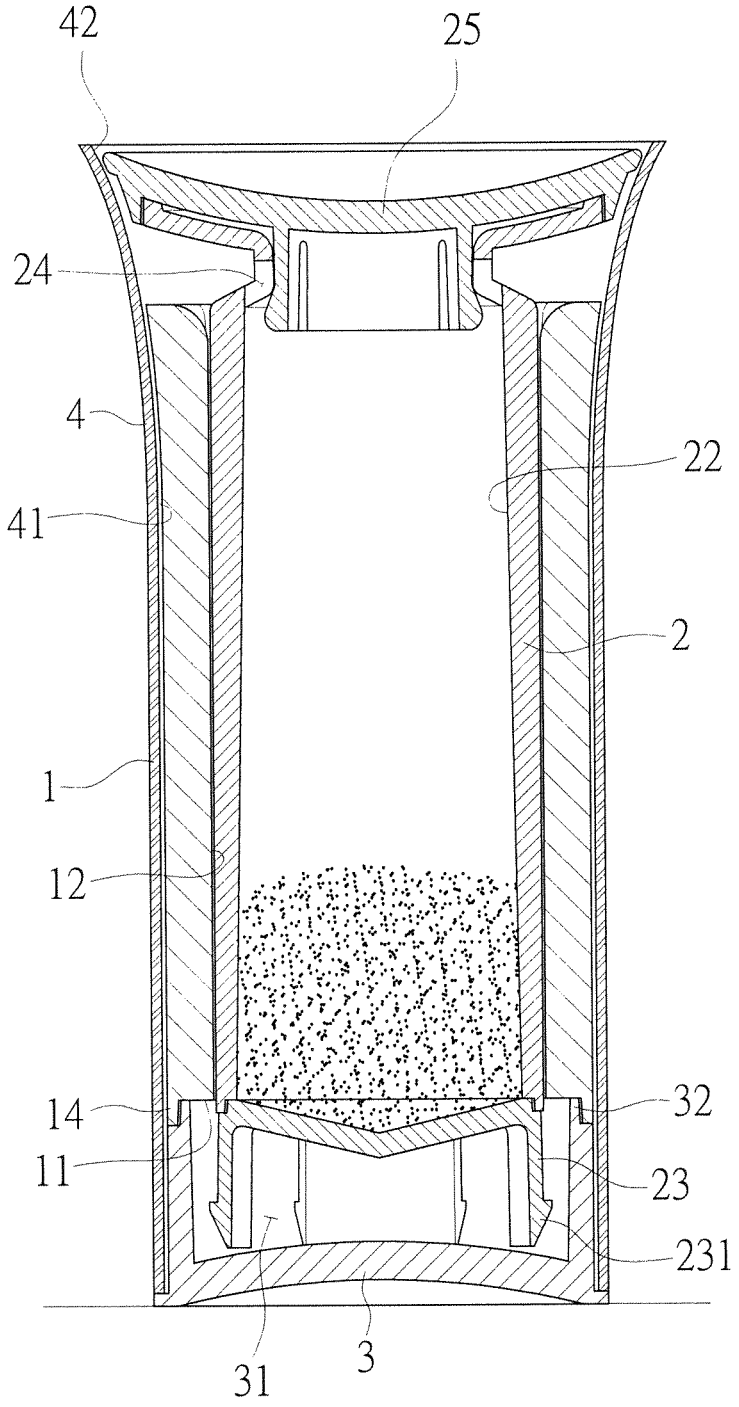
FIG. 3 is a side sectional view of a seasoning jar when it is not used according an embodiment of this disclosure.

First, please refer to FIGS. 1-4. FIGS. 1-4 show a structure of a seasoning jar according to an embodiment of this disclosure. The seasoning jar has a jar body 1. A position restriction groove 11 is concavely disposed at the bottom of the jar body 1. A through hole 12 is disposed in the central axis of the jar body 1 and reaches the position restriction groove 11. Several positioning grooves 13 are axially and equiangularly disposed on the wall of the through hole 12. A step-shaped edge 14 is disposed on the bottom peripheral edge of the jar body 1.

An accommodating tube 2 is sleeved in the through hole 12. Several positioning ribs 21 are axially and equiangularly disposed on the wall of the accommodating tube 2. The positions of these positioning ribs 21 are corresponding to the positioning grooves 13. An accommodating space 22 is formed in the interior of the accommodating tube 2. A stopper 23 is fixedly connected on the bottom of the accommodating tube 2, and a ring flange 231 is disposed on the peripheral edge of the stopper 23 to abut against the bottom of the position restriction groove 11. Plural openings 24 are disposed on upper wall of the accommodating tube 2 to communicate with the accommodating space 22. The top end of the accommodating tube 2 is opened, and a sealing cover 25 is disposed to cover the upper open end of the accommodating tube 2.

A bottom cover 3 has an accommodating groove 31 on a top end of the bottom cover 3. The accommodating groove 31 is used to receive the stopper 23 of the accommodating tube 2. A step-shaped section 32 is formed on the upper peripheral edge of the bottom cover 3 to fixedly connect the step-shaped edge 14 at the bottom of the jar body 1.

A shell 4 is provided. A sleeve hole 41 is disposed in the central axis to sleeve and join the jar body 1 and the bottom cover 3 correspondingly. A tapered opening 42 is formed on a top end of the sleeve hole 41 of the shell 4. The shape of the sealing cover 25 of the accommodating tube 2 is also tapered to correspondingly seal the tapered opening 42 of the shell 4.

Accordingly, when the seasoning jar is used, the sugar, salt, or pepper is poured into the accommodating space 22 of the accommodating tube 2, and the open end of the accommodating tube 2 is covered by the sealing cover 25 to finish the loading of the sugar, salt, or pepper.

Please see FIGS. 1-5. When a user wants to use the seasoning, such as sugar, salt, or pepper, in the seasoning jar, the seasoning jar is tilted to an angle to make the end of the sealing cover 25 of the seasoning jar is faced down. The accommodating tube 2 in the through hole 12 slides down and is stopped by the ring flange 231 of the stopper 23 against the bottom of the position restriction groove 11. Therefore, the accommodating tube 2 won't entirely slide out from the jar body 1, just partially slide out from the jar body 1. Then, the seasoning in the jar can be poured out through the openings 24 and falls on foods to improve the food delicious.

Figure 4:
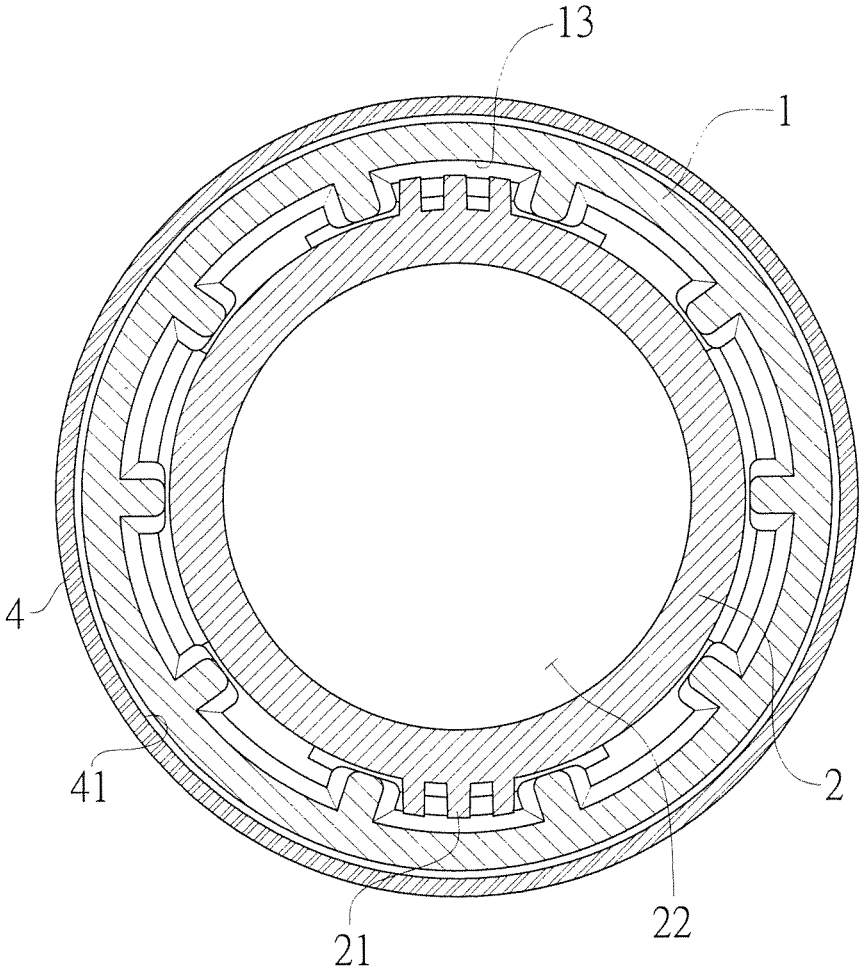
FIG. 4 is a horizontal cross-sectional view of a seasoning jar according an embodiment of this disclosure.
Figure 5:
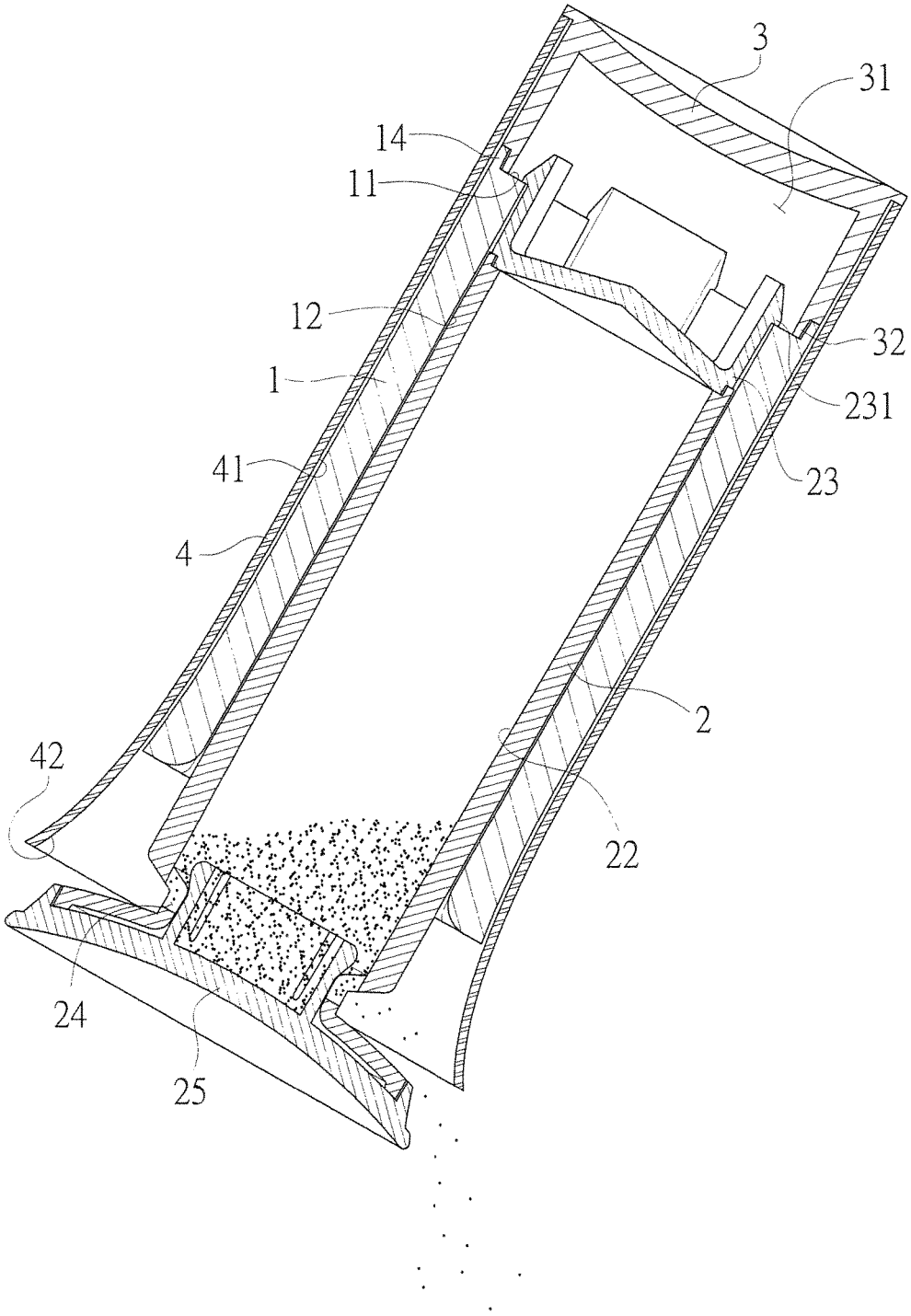
FIG. 5 is a side sectional view of a seasoning jar when it is used according an embodiment of this disclosure in a using state.

Next, please see FIGS. 4-5. After adding the seasoning, the jar is placed uprightly. The accommodating tube 2 will automatically slide into the jar body 1 by gravity. Therefore, the vias 24 will be shielded by the wall of the through hole 12 of the jar body 1. The tapered sealing cover 25 can tightly cover the tapered opening 42 of the shell 4 to avoid outside air from entering the accommodating tube 2 to make the seasoning damp, agglomeration, and thus deterioration. Meanwhile, insects, such as ants, also cannot enter the seasoning jar to elevate health.

1. The seasoning jar is only needed to be tilted to an angle when used, and the accommodating tube can be exposed to pour out the seasoning inside the accommodating tube through the vias of the jar body. Therefore, even for the old persons with poor eyesight, it is easy to accomplish the movements of adding seasoning to foods.

2. The accommodating tube can slide into the jar body by gravity when the jar is placed uprightly. At the same time, the vias will be shielded by the wall of the through hole of the jar body. Therefore, it is impossible to forget close the vias, and thus the seasoning won't be damped, agglomerated and deteriorated, or the jar won't be entered by insects and ants.

3. In the structure of the seasoning jar, positioning grooves are disposed on the wall of the through hole to receive the positioning ribs on the wall of the accommodating tube. This design can avoid the accommodating tube from rotating, and the stability of pouring out the seasoning can be maintained.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A seasoning jar, comprising:

a shell having a through bore extending axially therethrough between open opposing top and bottom ends of the shell;

a jar body joined to the shell within the through bore and having a position restriction groove concavely disposed at a bottom of the jar body and a through hole extending axially along a central axis of the jar body;

an accommodating tube slidably displaceably sleeved in the through hole of the jar body, the accommodating tube having a hollow accommodating space defined between opposing upper and lower open ends, and a plurality of openings formed through an upper wall portion of the accommodating tube adjacent the open upper end of the accommodating tube, the plurality of openings being in open communication with the accommodating space and a space external to the accommodating tube;

a stopper affixed to the lower open end of the accommodating tube to form a closure therefore and being slidably displaceable therewith, the stopper having a ring flange formed on a peripheral edge thereof to abut against a bottom of the position restriction groove and thereby limit slidable displacement of the accommodating tube into the through hole of the jar body;

a sealing cover coupled to the open end of the accommodating tube to form a closure therefore and being displaceable therewith, the sealing cover correspondingly forming a displaceable closure for the open top end of the shell; and a bottom cover fixedly connected the bottom of the jar body, and having an accommodating groove formed therein to receive the stopper, wherein responsive to rotation of the seasoning jar to a position orienting the accommodating tube angularly downward, the accommodating tube will be slidably displaced by gravitational force along with the sealing cover, and thereby release at least a portion of a composition disposed in the accommodating space through the plurality of openings and discharged from the open top end of the shell.

2. The seasoning jar of claim 1, wherein the jar body has a plurality of positioning grooves axially and equiangularly disposed on the wall of the through hole of the jar body, and the accommodating tube has a plurality of positioning ribs to respectively fit in the positioning grooves of the jar body.

3. The seasoning jar of claim 2, wherein the bottom of the jar body has a step-shaped peripheral edge, and a top peripheral edge of the bottom cover has a complementary step-shaped section to fixedly connect with the bottom step-shaped peripheral edge of the jar body.

4. The seasoning jar of claim 2, wherein the open top end of the shell has a tapered shape and the sealing cover also has a corresponding tapered shape to tightly cover the open top end of the shell.

5. The seasoning jar of claim 1, wherein the open top end of the shell has a tapered shape and the sealing cover also has a corresponding tapered shape to tightly cover the open top end of the shell.

6. The seasoning jar of claim 1, wherein the bottom of the jar body has a step-shaped peripheral edge, and a top peripheral edge of the bottom cover has a complementary step-shaped section to fixedly connect with the bottom step-shaped peripheral edge of the jar body.

7. The seasoning jar of claim 1, wherein the open top end of the shell has a tapered shape and the sealing cover also has a corresponding tapered shape to tightly cover the open top end of the shell.

* * * * *